US005564645A

United States Patent [19]

Lissoni

[11] Patent Number: 5,564,645

[45] Date of Patent: Oct. 15, 1996

[54] ROLL SUPPORT HUB BRAKING MECHANISM

[75] Inventor: Adelio Lissoni, VaRese, Italy

[73] Assignee: Minnesota Mining and Manufacturing Company, St. Paul, Minn.

[21] Appl. No.: 394,101

[22] Filed: Feb. 24, 1995

[51] Int. Cl.[6] ..... B65H 77/00

[52] U.S. Cl. ..... 242/423.1; 242/597.6

[58] Field of Search ..... 242/423, 423.1, 242/597.6

[56] References Cited

U.S. PATENT DOCUMENTS

| | | | |
|---|---|---|---|
| 1,708,344 | 4/1929 | Winkler . | |
| 2,093,562 | 9/1937 | Hope . | |
| 2,388,121 | 10/1945 | Carbonneau | 242/45 |
| 2,509,791 | 5/1950 | Swonson | 242/423.1 |
| 3,738,588 | 6/1973 | Ayers . | |
| 3,770,221 | 11/1973 | Stern . | |
| 3,972,459 | 8/1976 | Cooper | 225/47 |
| 4,002,238 | 1/1977 | Cameron et al. | 206/408 |
| 4,099,601 | 7/1978 | Pittman | 188/163 |
| 4,121,783 | 10/1978 | Wölfinger et al. . | |
| 4,141,519 | 2/1979 | Tarrson et al. | 242/137.1 |
| 4,248,391 | 2/1981 | Ness . | |
| 4,625,931 | 12/1986 | Tamura et al. | 242/423.1 |
| 4,878,631 | 11/1989 | Tanovici | 242/423.1 |
| 5,263,607 | 11/1993 | Temesvary et al. | 221/304 |

FOREIGN PATENT DOCUMENTS

| | | |
|---|---|---|
| 0210800A3 | 2/1987 | European Pat. Off. . |
| 454270 | 1/1928 | Germany . |
| 79110740 | 9/1991 | Taiwan . |

*Primary Examiner*—John P. Darling
*Attorney, Agent, or Firm*—Gary L. Griswold; Walter N. Kirn; Charles D. Levine

[57] ABSTRACT

An improved braking system for a rotatable roll support hub for a roll product of web material is capable of providing a smoother and progressive braking action which uses a less powerful compression spring. This can be achieved by utilizing a friction element that has frustoconical shaped friction surfaces. Specifically, the friction element comprises a frustoconical disc that floats between a similar frustoconical surface that rotates with the roll support hub and an opposite similar frustoconical surface on the pressure disc. Preferably, a rim flange is provided as part of the pressure disc that forces the friction element into wedged engagement on the frustoconical friction surface of the roll support hub. The advantages are achieved for providing a smoother progressive braking action which is applicable to any roll support hub on which a controlled braking force is desirable. Such may include manual tape dispensers or any other roll support hub for any roll of web material which is associated with an automatic, semi-automatic, or manual dispensing or applying apparatus.

2 Claims, 1 Drawing Sheet

ROLL SUPPORT HUB BRAKING MECHANISM

TECHNICAL FIELD

The present invention relates generally to roll support hubs which are rotatably supported on a dispensing or applying apparatus and which can be used for supporting a variety of roll products, such as adhesive tape rolls. More specifically, the present invention is directed to a manner of controlling the rotation of the hub about its support and to provide a braking action against the rotation of the roll.

BACKGROUND

Roll support hubs are known to be used on automatic, semi-automatic, and manual apparatuses from which roll products are to be dispensed or applied. Moreover, it is known to provide a friction braking mechanism which acts against the rotation of such a roll support hub so that the tension of the material dispensed can be controlled and to prevent over-rotation of the roll when demand is ceased.

Adhesive tape dispensers and applicators are one type of device which typically requires a roll support hub. Many types of tape dispensers and applicators are known depending on the area of use, for example: for industrial packaging lines, store packaging and wrapping, or in an office environment. Typically, the purpose of these type tape dispensers is to facilitate the use of the tape from such a dispenser, and to do so in accordance with the specific application.

Manual tape dispensers are typically used in small packaging departments and, as well known, typically consist of a roll support hub which rotates on a support axle or bolt which is projected from a support base that may be equipped with a handle. Other conventional features include guiding mechanisms and cutting mechanisms. Such roll support hubs are known to include a braking system, normally comprising a controlled friction braking system, with its primary purpose to regulate the rotation of the tape roll. The braking system, of such known tape dispensers, includes on one side of the roll support hub a friction surface in a perpendicular plane to the axis of rotation which is fixed with the roll support hub and rotates with the roll support hub around the support axle and by a sliding pressure disc that is axially slidably mounted to the support axle and on which operates an adjustable spring. The braking action is determined by the amount of pressure of the spring applied to the pressure disc which is frictionally engaged with the friction surface of the roll support hub.

A typical set-up of a roll support hub that is provided as part of a manual tape dispenser is shown in FIG. 1. A roll support hub 1 is illustrated and which is rotatable about a support axle 2 which is in turn fixed with a tape dispenser support 3, again which is typically provided with a handle and a cutting means. Such support axles 2 are typically secured to the support frame 3 to be non-rotational, such as by a rivet shown at 4. The hub 1 includes a bearing 5 which is rotational on the support axle 2. On the side of the roll support hub 1 away from the support frame 3, a shoulder 6 is provided extending from the bearing 5 and which provides a friction surface that is in a general plane perpendicular to the axis of the support axle 2.

At the other end of the support axle 2 from the support frame 3, a non-circular portion 7 of the support axle 2 extends above the plane of the friction surface of the shoulder 6. By this, a pressure disc 8 having a corresponding opening is supported to be axially slideable on the non-circular portion 7, but rotationally fixed with the support axle 2. A knob 9 is adjustably mounted to the support axle 2, such as by a bolt 10 so that the distance between the lower surface of the knob 9 and the upper surface of the pressure disc 8 can be adjustably defined. Between the lower surface of the knob 9 and the pressure disc 8, a compression spring 11 is provided which provides a biasing force against the pressure disc 8 toward the friction surface of the roll support hub 1.

Between the pressure disc 8 and the friction surface of the shoulder 6, a friction disc 12 is also provided. The friction disc 12 is typically rotatable about the non-circular portion 7 of the support axle 2. As can be seen, the rotatable roll support hub 1 rotates about the fixed support axle 2. As the roll support hub 1 rotates, its shoulder portion 6 experiences relative movement between itself and the non-rotational pressure disc 8. The compression spring 11 provides the force against the pressure disc 8 which increases the friction between the surfaces of the pressure disc 8, the friction disc 12, and the friction surface of the shoulder 6. By adjustment of the knob 9, the force generated by the compression spring 11. can be controlled so as to increase or decrease the friction between the aforementioned elements. By this, a controlled friction can be applied to the roll support hub 1 to regulate the rotation of the roll hub support 1 and thus the dispensing of material from the roll.

This set-up, as mentioned above, is at present almost universally used; however, certain deficiencies exist. The ring-shaped friction disc, and the friction surfaces on the pressure disc 8 and the shoulder 6 are considerably reduced so that, to obtain a sufficient braking force, it is necessary to use a particularly strong compression spring 11 that is adjusted to provide a heavy load. A first specific problem is that the braking action under such a heavy load can be difficult to control, which can frequently result in dispensing with too much or not enough braking action. Additionally, it is a problem that the edge of the bearing 5 of the roll support hub 1 that is adjacent the support frame 3 is pushed against the support frame 3 with a force that is so strong that it causes a rapid wearing of the base portion of the bearings. Referring again to FIG. 1, in order to deal with this latter problem, it is known to provide a sleeve 13 at the base portion of the bearing 5, although this clearly adds to the complexity of the manufacturing and increases costs of production. Normally, the roll support hub 1 is made of a plastic material, such as polypropylene, which is relatively ineffective against wear. The sleeve 13 can be made of a material that is more effective against wear, for example Delrin™, which is extremely effective against wear and tear, but is substantially more expensive.

SUMMARY OF THE PRESENT INVENTION

It is a primary purpose of the present invention to provide an improved braking system to a rotatable roll support hub for a roll product of web material that is capable of providing a smoother and progressive braking action which uses a less powerful compression spring. This can be achieved by utilizing a friction element that has frustoconical shaped friction surfaces. Specifically, the friction element comprises a frustoconical disc that floats between a similar frustoconical surface that rotates with the roll support hub and an opposite similar frustoconical surface on the pressure disc. Preferably also, a rim flange is provided as part of the pressure disc that forces the friction element into wedged engagement on the frustoconical friction surface of the roll support hub.

The above described advantages are achieved in the manner noted above for providing a smoother progressive braking action which is applicable to any roll support hub on which a controlled braking force is desirable. Such may include manual tape dispensers, as described above, or any other roll support hub for any roll of web material which is associated with an automatic, semi-automatic, or manual dispensing or applying apparatus.

Further characteristics and advantages of the braking system of the present invention will be evident from the detailed description which follows, which is directed to a preferred embodiment, which is given and illustrated by the attached drawing.

DETAILED DESCRIPTION OF THE PREFERRED EMBODIMENT

Figure 1:
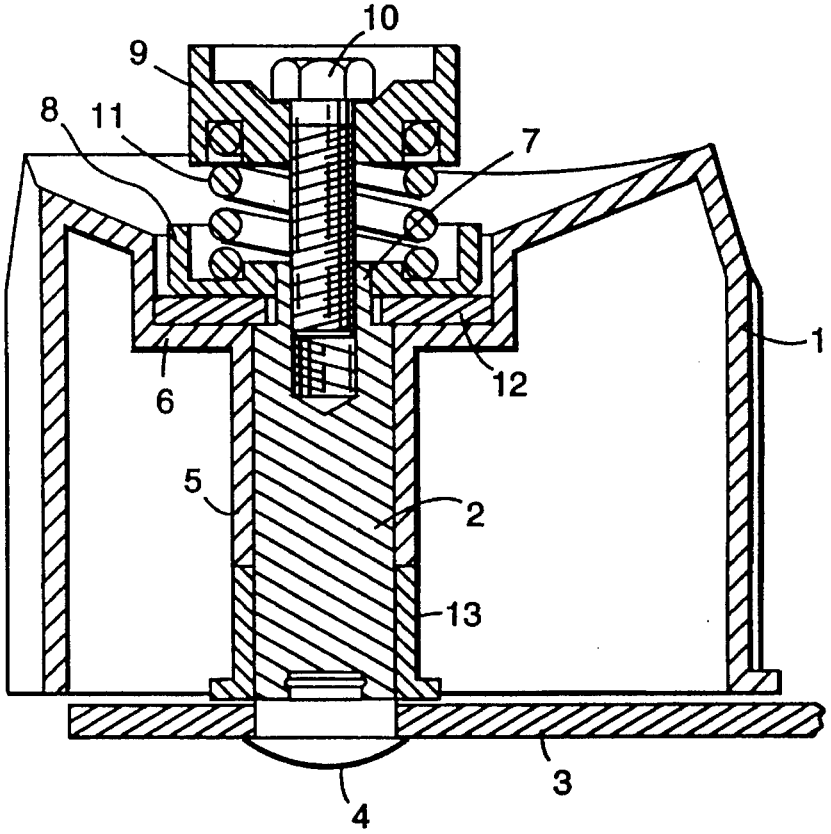
Fig.1 Prior Art
FIG. 1 is an asymmetrical axial cross-sectional view with the right side of the figure as viewed in FIG. 1 taken at a 90° plane and the left side at a plane less than 90° of a Prior Art roll support hub and braking system.
Figure 2:
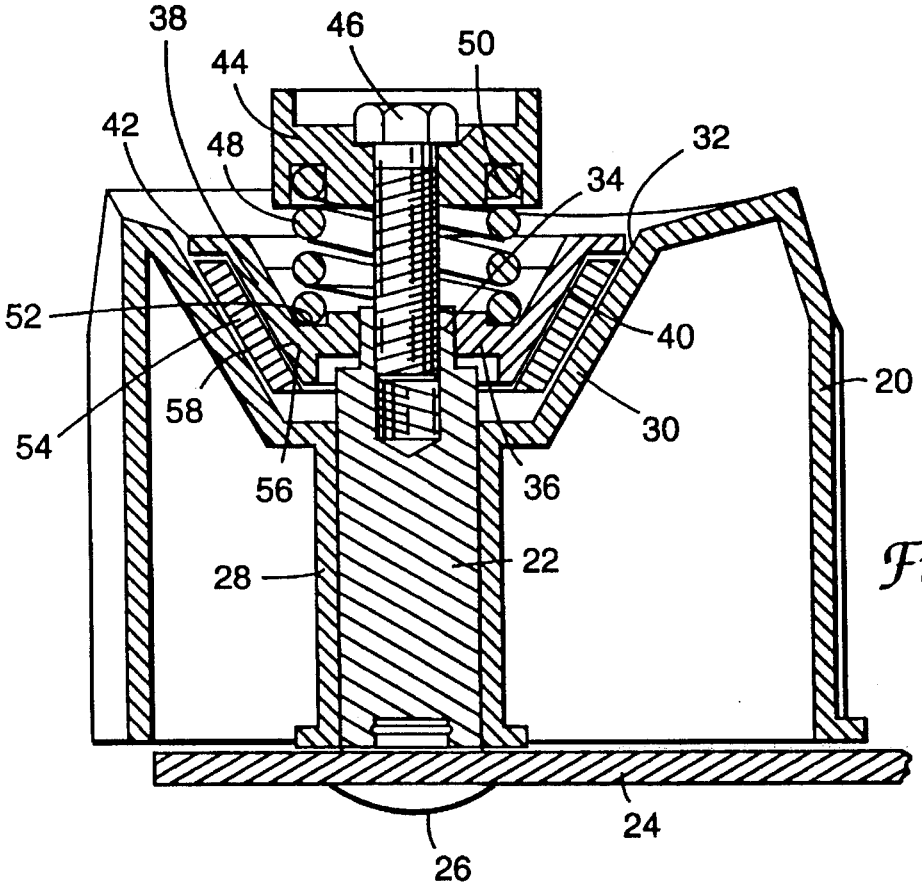
FIG. 2 is a similar axial cross-sectional view as taken in FIG 1. but showing a roll support hub and a braking system in accordance with a preferred embodiment of the present invention.

A preferred embodiment in accordance with the present invention is illustrated in FIG. 2. Basically, a roll support hub 20 is provided that has a number of similar components and functionality as that illustrated in the FIG. 1 Prior Art illustration, except that the components having the corresponding friction surfaces are provided in the manner of frustoconical surfaces. The roll support hub 20 is rotatably supported by a support axle 22 which is in turn preferably non-rotationally fixed with a support frame 24 by any conventional means such as shown by a rivet 26. The support frame 24 can comprise a side frame element of any conventional manual applicator or dispenser from which web material provided in roll form, such as adhesive tape, can be dispensed. Likewise, the support frame 24 can be a portion of a support for a semi-automatic or automatic machine from which any roll material may be dispensed. One specific manual dispenser to which the present invention is specifically applicable is the manual adhesive tape dispenser commercially available from Minnesota Mining and Manufacturing Company of St. Paul, Minn. as Scotch™ Model H-181 hand dispenser. An example of an automatic taping machine to which the subject roll support hub may be applied is the 3M™ Model 800-AF case sealer available from Minnesota Mining and Manufacturing Company of St. Paul, Minn. In any case, the roll support hub of the present invention could be merely rotationally mounted to a fixed axle connected with the existing support structure.

The roll support hub 20 includes a bearing 28 which rides on the outer surface of the support axle 22 during rotation of the roll support hub 20. At the end of the bearing 28, away from the support frame 24, a frustoconical portion 30 of the roll support hub 20 is provided having a friction surface 32 which faces toward the support axle 22 by at least some degree. The angle of the friction surface 32 from a perpendicular plane to the axis of rotation can be any angle less than 90° but greater than 0°, with the understanding that the angle affects the amount of surface area, as described below. As illustrated, the roll support hub 20 integrally includes the bearing 28 and frustoconical portion 30; however, it is understood that the roll support hub 20 could be made of multiple components. The roll support hub 20 is also preferably dimensioned such that at its outer diameter it is sized to fit within the core of a roll of web material which is to be dispensed from the particular dispenser. Preferably, the roll support hub 20 is sized to frictionally engage the inner surface of the core of the roll of web material to be dispensed so that the roll material rotates with the roll support hub 20 by a frictional engagement.

At the end of the support axle 22, away from the support frame 24, a non-circular portion 34 is provided onto which a pressure disc 36 is disposed. The pressure disc 36 preferably includes an opening which is similarly shaped to the non-circular portion 34 so that the pressure disc 36 can slide along the length of the non-circular portion 34 but cannot rotate relative to the support axle 22. The pressure disc 36 also preferably includes a frustoconical portion 38 having a similar slope to the slope of the frustoconical portion 30 of the roll support hub 20. The frustoconical portion 38 also preferably provides a friction surface 40 on its surface facing the friction surface 32 of the frustoconical portion 30 of the roll support 20. At the wide end of the pressure disc 36, a rim flange 42 is also preferably provided extending away from the support axle 22 and at the upper edge of the friction surface 40. The rim flange 42 may not be provided at all, or may be provided lower along the friction surface 40 as will be more fully understood with the description of the operation below.

A knob 44 is adjustably connected with the support axle 22 by a threaded bolt 46 so that the space between the lower surface of the knob 44 and the upper surface of the pressure disc 36 can be varied by rotating the knob 44 which in turn moves the threaded bolt 46 to extend or within the bolt 46 to the support axle 22.

A compression spring 48 is positioned between the knob 44 and the pressure disc 36 and is provided for exerting a biasing force against the pressure disc 36 for urging it toward the frustoconical portion 30 of the roll support hub 20. Preferably, the compression spring 48 is positioned within a receiving groove 50 on the lower side of the knob 44 on the one end and within a receiving groove 52 provided on the upper surface of the pressure disc 36 on the other end. It is a significant advantage of the present invention that the compression spring 48 can have a significantly lower spring force than that of prior art devices, because less force is required in order to achieve similar braking forces, as will be snore fully described in the operation below.

A frustoconical friction disc 54 is also preferably provided between the friction surface 40 of the pressure disc 36 and the friction surface 32 of the frustoconical portion 30 of the roll support hub 20, although not necessary. The friction disc 54 provides an inner friction surface 56 and an outer friction surface 58 which engage with friction surfaces 40 and 32, respectively. The friction disc 54 may be freely rotatable about the support axle 22, although it may be fixed with one of the pressure disc 36 or the roll support hub 20. However, if it is desirable to specifically generate the friction braking action between the friction disc 54 and the frustoconical 30 of the roll support hub 20, for example, it would be desirable to prevent the friction disc 54 from rotation about the support axle 22. To do this, the friction disc 54 may be fixed with the pressure disc 36 by any conventional means or may just be rotationally fixed such as providing corresponding ribs and grooves on the friction surfaces 40 and 56 which engage with one another to prevent the rotation of the friction disc 54 when the pressure disc 36 is urged against the friction disc 54. It is also noted that with the provision of the rim flange 42, the frustoconical friction disc 54 should be appropriately dimensioned to fit within the space between the pressure disc 36 and the frustoconical portion 30 of the roll support hub 20, so that an appropriate frictional force can be generated. The rim flange 42 additionally provides a force to urge the frustoconical friction disc 54 toward the frustoconical portion 30 of the roll support hub 20.

The result of the above-described construction is the provision of frictional surface areas that are significantly greater than in the case of the prior art roll support hub illustrated in FIG. 1 and described above in the Background section of this application. In order to change the frictional surface area, the angle of the conical surfaces can be varied. With this construction, the frictional surface area of the embodiment shown in FIG. 2 can be as much as doubled the frictional surface area of that illustrated in FIG. 1. Moreover, the pressure created by the compression spring 48 on the pressure disc 36 translates both to pressure applied by the friction disc 54 in the direction perpendicular to the frustoconical portion 30 of the roll support hub 20 and in the direction of the axis of the support axle 22, which may be mainly caused by the rim flange 42 acting to force the friction disc 54 to the frustoconical portion 30 of the roll support hub 20.

In operation, a user would simply load a roll of web material, such as adhesive tape, onto the roll support hub 20 so that the roll of material rotates with the roll support hub 20. As the roll material is demanded or dispensed, the roll support hub 20 rotates about the support axle 22 on its bearing 28. At all times, the compression spring 48 urges the pressure disc 36 to move along the non-circular portion 34 in the axial direction toward the support frame 24. The result of this urging is the additional urging of the frustoconical portion 38 of the pressure disc 36 into the frustoconical friction disc 54 and likewise into the frustoconical portion 30 of the roll support hub 20. During rotation of the roll support hub 20, the pressure disc 36 does not rotate and the friction disc 54 may or may not rotate if the friction disc 54 is fixed with the pressure disc 36, all the friction is generated between the outer surface 58 of the friction disc 54 and the friction surface 32 of the frustoconical portion 30 of the roll support hub 20. If the friction disc 54 is freely rotatable, some friction would also be provided between the inner friction surface 56 and the friction surface 40 of the frustoconical portion 38 of the pressure disc 36. Again, because of the increase in frictional surface areas, the compression spring 48 can be significantly less strong than the spring force associated with prior art mechanisms. Since the spring force is weaker, the braking action can be more effectively controlled and can be progressive over a greater range and smoother throughout the range. In order to adjust the braking force, a user would merely rotate the knob 44 to change the distance between its lower surface and the pressure disc 36 and thus change the spring force. Another important advantage of the use of a weaker spring, is the reduction of force generated between the base of bearing 28 and the support frame 24. With a weaker spring, less force is generated between these surfaces during rotation, and it is not necessary to provide a wear-resistant sleeve, such as has been done with prior are supports. The entire bearing 28 can thus be made integral with the roll support hub 20 and of the same material.

I claim:

1. An apparatus for supporting web material provided in roll form and from which the web material is to be dispensed, the apparatus comprising:

a support frame having a support axle extending therefrom;

a rotatable support hub rotatably disposed on the support axle, the rotatable support hub having a roll supporting surface for engaging the roll of web material when supported thereon so as to rotate together and a frustoconical hub friction surface;

a friction braking means for controlling the rotation of the rotatable support hub about the support axle, the friction braking means including a pressure element that is rotatably fixed with the support axle, and is axially slideable thereto, the pressure element having a frustoconical pressure friction surface facing the hub friction surface, a biasing means for urging the pressure friction surface toward the hub friction surface, and a flange extending from the pressure element adjacent to the pressure friction surface;

a bias adjustment means for controllably varying the frictional force of the braking means;

a frustoconical friction disc disposed between the pressure friction surface and the hub friction surface, wherein the flange engages with an edge of the frustoconical friction disc and urges the frustoconical friction disc in an axial direction of the support axle; and means for rotatably fixing the frustoconical friction disc with the pressure element.

2. A tape dispenser comprising the apparatus for supporting and dispensing web material of claim 1.

* * * * *